US008485690B1

(12) United States Patent
Garcia et al.

(10) Patent No.: US 8,485,690 B1
(45) Date of Patent: Jul. 16, 2013

(54) DECORATIVE LIGHT STRING CLIP DEVICE

(76) Inventors: Virginia Garcia, Lancaster, CA (US); Valerie Garcia, Lancaster, CA (US)

( * ) Notice: Subject to any disclaimer, the term of this patent is extended or adjusted under 35 U.S.C. 154(b) by 32 days.

(21) Appl. No.: 13/228,165

(22) Filed: Sep. 8, 2011

(51) Int. Cl.
*F21V 21/00* (2006.01)

(52) U.S. Cl.
USPC . 362/249.14; 362/145; 362/152; 362/249.01; 362/249.15; 362/249.16; 362/249.18; 362/396

(58) Field of Classification Search
USPC ..... 362/145, 152, 249.01, 249.14, 249.16, 362/253, 396, 249.11, 249.15, 249.18, 391
See application file for complete search history.

(56) References Cited

U.S. PATENT DOCUMENTS 4,462,065 A 7/1984 Rhodes
4,516,193 A 5/1985 Murphy
4,870,547 A 9/1989 Crucefix
4,971,200 A 11/1990 Huang et al.
D369,957 S 5/1996 Blanton
5,669,709 A * 9/1997 Adams ..... 362/396
5,746,504 A 5/1998 Dodson
6,109,569 A * 8/2000 Sakaida ..... 248/75
6,328,459 B1 * 12/2001 Adams ..... 362/396
6,644,836 B1 * 11/2003 Adams ..... 362/396

* cited by examiner

*Primary Examiner* — Stephen F Husar
*Assistant Examiner* — Meghan Dunwiddie

(57) ABSTRACT

A decorative light string clip device is provided for holding a string of lights in a desired configuration on a tree branch or other elongated support structure. The device includes an arcuate member having a pair of spaced free ends. The arcuate member has an outer perimeter edge extending between the free ends. A plurality of notches is provided in the member. Each of the notches extends inwardly from the outer perimeter edge of the member. The notches are radially positioned in spaced relationship around the member.

9 Claims, 6 Drawing Sheets

DECORATIVE LIGHT STRING CLIP DEVICE

BACKGROUND OF THE DISCLOSURE

1. Field of the Disclosure

The disclosure relates to light clip devices and more particularly pertains to a new light clip device for holding a string of lights in a desired configuration on a tree branch or other elongated support structure.

2. Summary of the Disclosure

An embodiment of the disclosure meets the needs presented above by generally comprising an arcuate member having a pair of spaced free ends. The arcuate member has an outer perimeter edge extending between the free ends. A plurality of notches is provided in the member. Each of the notches extends inwardly from the outer perimeter edge of the member. The notches are radially positioned in spaced relationship around the member.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
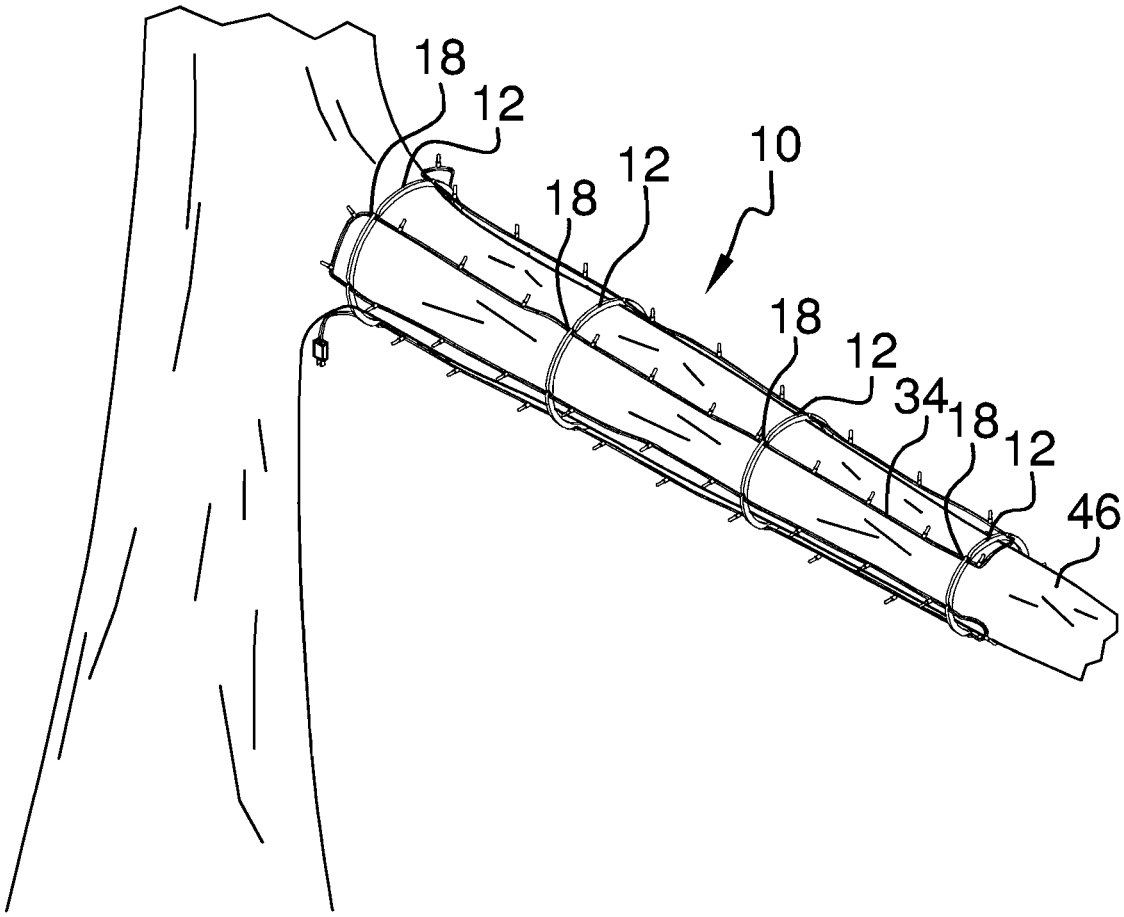
FIG. 1 is a top front side perspective view of a decorative light string clip device according to an embodiment of the disclosure in use.
Figure 2:
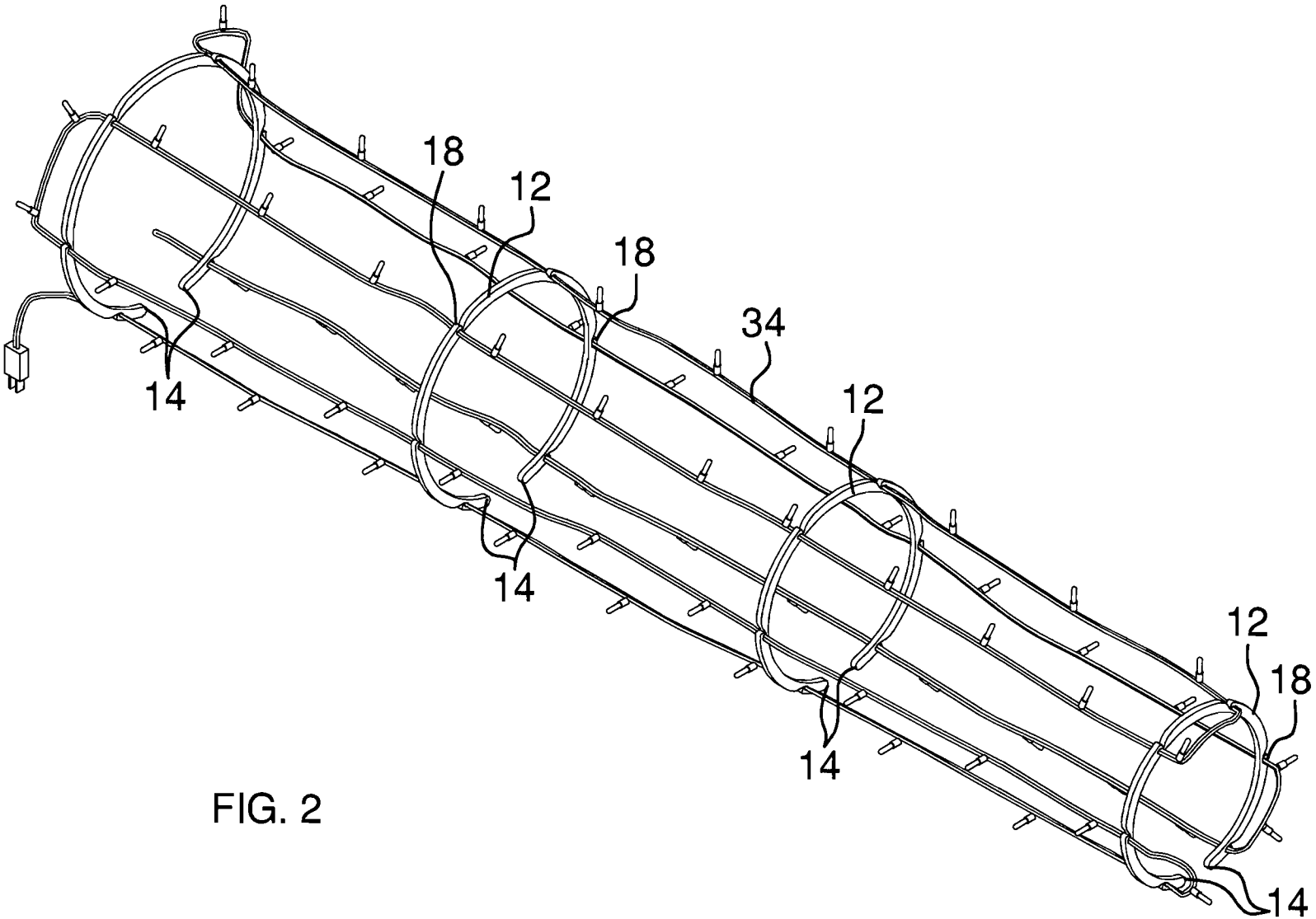
FIG. 2 is a top front side perspective view of an embodiment of the disclosure.
Figure 3:
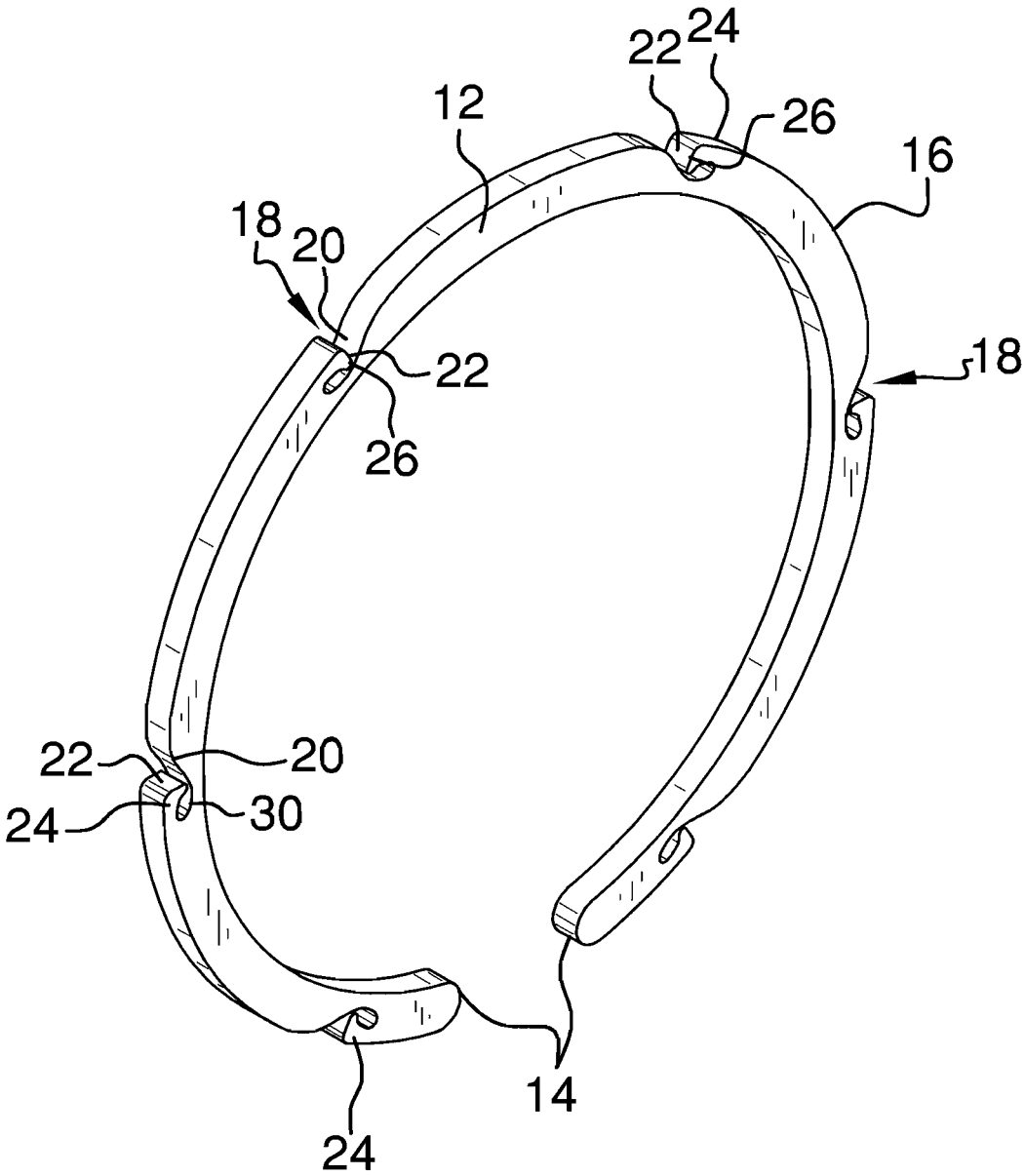
FIG. 3 is a top front side perspective view of an embodiment of the disclosure.
Figure 4:
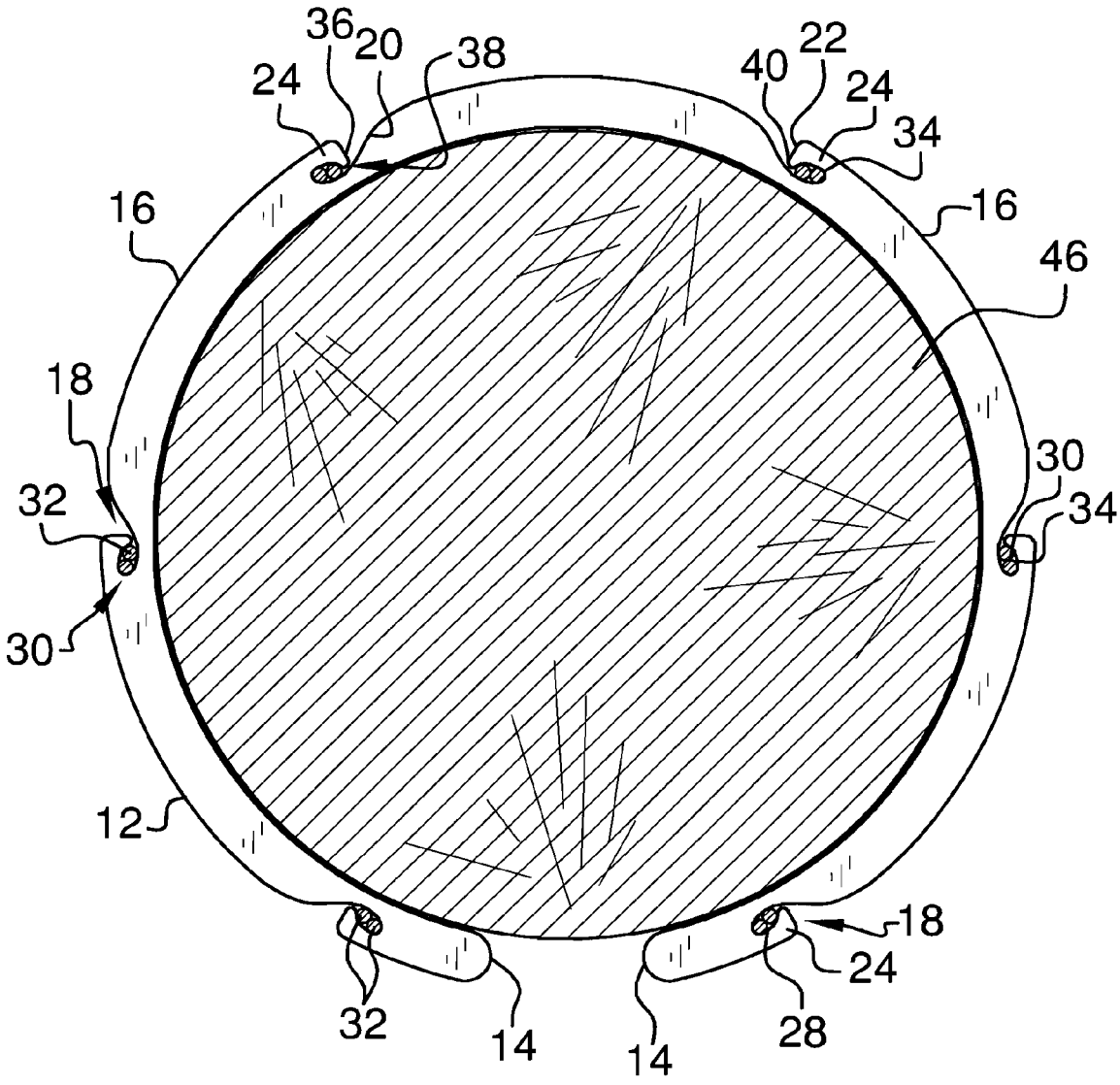
FIG. 4 is a front view of an embodiment of the disclosure.
Figure 5:
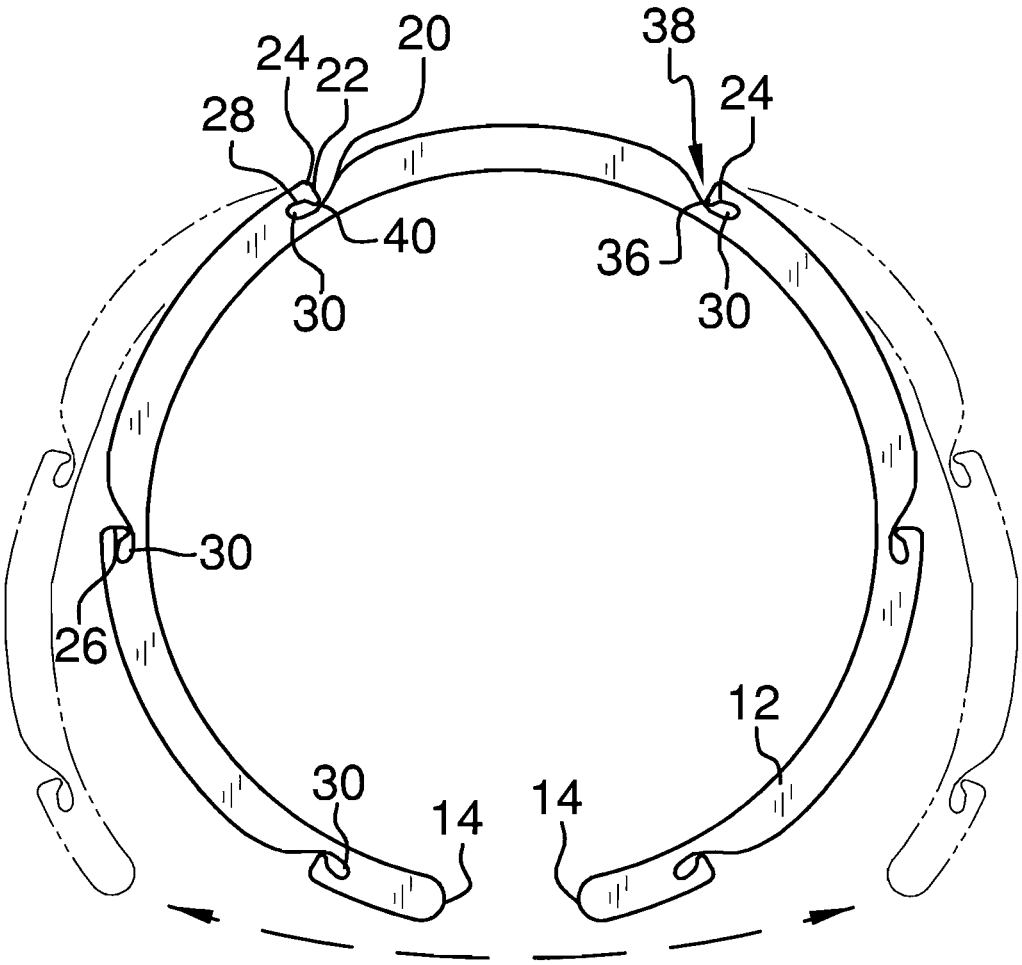
FIG. 5 is a front view of an embodiment of the disclosure.

With reference now to the drawings, and in particular to FIGS. 1 through 6 thereof, a new light clip device embodying the principles and concepts of an embodiment of the disclosure and generally designated by the reference numeral 10 will be described.

As best illustrated in FIGS. 1 through 6, the decorative light string clip device 10 generally comprises an arcuate member 12 having a pair of spaced free ends 14. The arcuate member 12 has an outer perimeter edge 16 extending between the free ends 14. A plurality of notches 18 is provided. Each of the notches 18 extends inwardly from the outer perimeter edge 16 of the member 12. The notches 18 are radially positioned in spaced relationship to each other around the member 12. Each notch 18 has a sloped side 20 positioned opposite a straight side 22. Both the sloped side 20 and the straight side 22 extend inwardly from the outer perimeter edge 16 into the member 12.

A plurality of arms 24 is provided. Each arm 24 extends into an associated one of the notches 18. Each arm 24 has a straight end 26 defining the straight side 22 of the associated notch 18. The straight side 22 of the notch 18 extends radially inward from the outer perimeter edge 16. Each arm 24 also includes a curved inner edge 28 defining a bulbous portion 30 of the associated notch 18. The bulbous portion 30 is configured for receiving a wire 32 from a decorative light string 34 therein. Each arm 24 has a barb 36 defined by a junction 38 between the bulbous portion 30 and a distal end 40 of the straight side 22 relative to the outer perimeter edge 16. Each arm 24 may also extend away from a nearest one of the free ends 14. Thus, urging the free ends 14 apart flexes the arcuate member 12 and urges each barb 36 towards the sloped side 20 of the associated notch 18.

Figure 6:
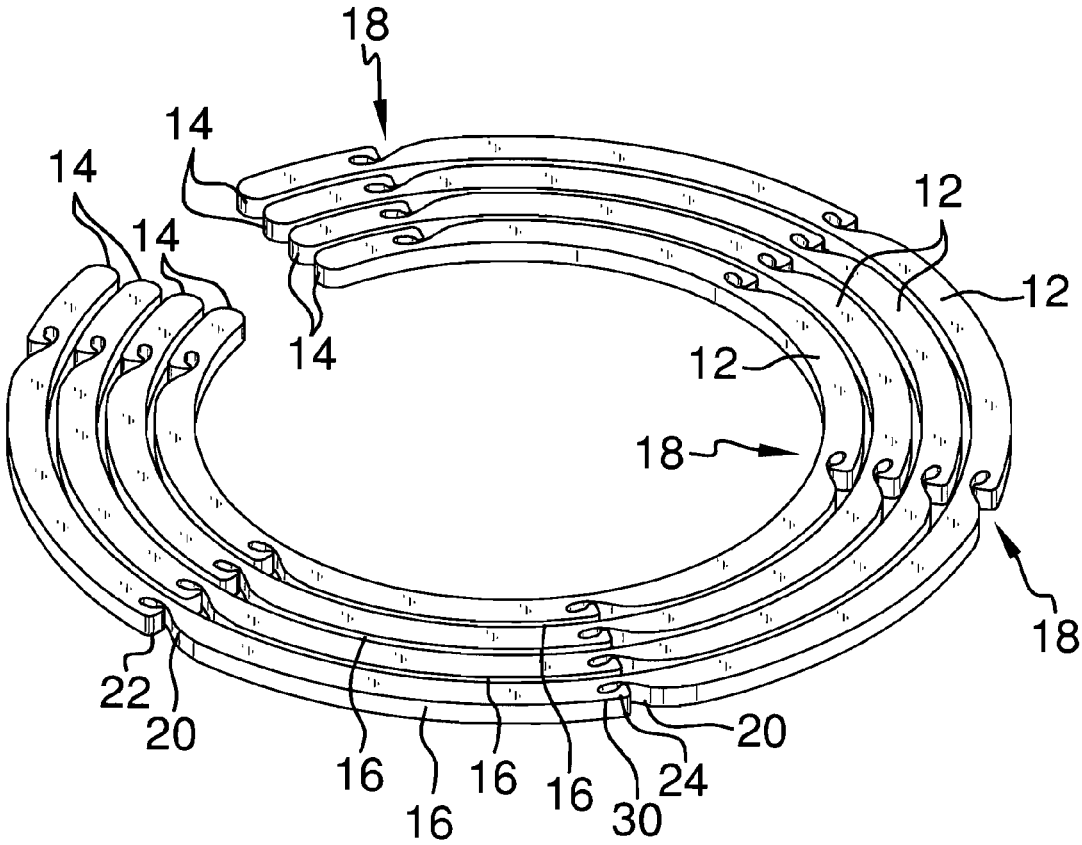
FIG. 6 is a top front side perspective view of an embodiment of the disclosure.

A plurality of arcuate members 12 may be provided. Each of the members 12 may have an equal number of the notches 18. Each arcuate member 12 may also have a unique radius whereby the arcuate members 12 are configured for spaced positioning along a length of a support structure 46 having a tapering diameter. The varying radii of the members 12 may also permit nested storage of the members 12 as shown in FIG. 6. The notches 18 may be radially distributed around the members 12 such that notches 18 of each member 12 align with notches 18 of an adjacently positioned member 12. Thus, the decorative light string 34 may be arranged into straight lines on the support structure 46 such as a tree branch. Alternatively, the members 12 may be twisted on the support structure 46 or the light string 34 coupled to the notches 18 of the members to provide spiraling or zigzag patterns that remain evenly spaced along the support structure 46.

In use, the free ends 14 of the member 12 are separated to pass over the support structure 46 and secure the member 12 to the support structure 46. Multiple members 12 may be similarly attached as desired. The wire 32 of the light string 34 is then coupled to the member 12 by inserting the wire 32 into each notch 18 such that the wire 32 is seated in the bulbous portion 30 and held in place by the barb 36.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A decorative light string clip device comprising:

an arcuate member having a pair of spaced free ends, said arcuate member having an outer perimeter edge extending between said free ends;

a plurality of notches, each of said notches extending inwardly from said outer perimeter edge of said member, said notches being radially positioned in spaced relationship around said member; and a plurality of arms, each arm extending into an associated one of said notches, each arm having a straight end defining a straight side of said associated notch, said straight side of said notch extending radially inward from said outer perimeter edge.

2. The device of claim 1, further including a plurality of said arcuate members, each of said members having an equal number of said notches.

3. The device of claim 1, further including each said notch having a sloped side positioned opposite said straight side, said sloped side extending inwardly from said outer perimeter edge.

4. The device of claim 3, further including each arm having a curved inner edge defining a bulbous portion of said associated notch, said bulbous portion being configured for receiving a wire therein.

5. The device of claim 4, further including each arm having a barb defined by a junction between said bulbous portion and a distal end of said straight side relative to said outer perimeter edge.

6. The device of claim 2, further including each of said arcuate members having a unique radius whereby said arcuate members are configured for spaced positioning along a length of a support structure having a tapering diameter.

7. The device of claim 5, further including each arm extending away from a nearest one of said free ends whereby urging said free ends apart flexes said arcuate member and urges each said barb towards said sloped side of said associated notch.

8. A decorative light string clip device comprising:

an arcuate member having a pair of spaced free ends, said arcuate member having an outer perimeter edge extending between said free ends;

a plurality of notches, each of said notches extending inwardly from said outer perimeter edge of said member, said notches being radially positioned in spaced relationship around said member, each said notch having a sloped side positioned opposite a straight side, said sloped side extending inwardly from said outer perimeter edge;

a plurality of arms, each arm extending into an associated one of said notches, each arm having a straight end defining said straight side of said associated notch, said straight side of said notch extending radially inward from said outer perimeter edge, each arm having a curved inner edge defining a bulbous portion of said associated notch, said bulbous portion being configured for receiving a wire therein, each arm having a barb defined by a junction between said bulbous portion and a distal end of said straight side relative to said outer perimeter edge, each arm extending away from a nearest one of said free ends whereby urging said free ends apart flexes said arcuate member and urges each said barb towards said sloped side of said associated notch.

9. The device of claim 8, further including a plurality of said arcuate members, each of said members having an equal number of said notches, each of said arcuate members having a unique radius whereby said arcuate members are configured for spaced positioning along a length of a support structure having a tapering diameter.

* * * * *